US008807282B2

(12) United States Patent
Streifinger

(10) Patent No.: US 8,807,282 B2
(45) Date of Patent: Aug. 19, 2014

(54) LUBRICANT SYSTEM

(75) Inventor: Helmut Streifinger, Munich (DE)

(73) Assignee: MTU Aero Engines GmbH, Munich (DE)

( * ) Notice: Subject to any disclaimer, the term of this patent is extended or adjusted under 35 U.S.C. 154(b) by 1341 days.

(21) Appl. No.: 11/994,980

(22) PCT Filed: Jun. 29, 2006

(86) PCT No.: PCT/DE2006/001116

§ 371 (c)(1),
(2), (4) Date: Jan. 7, 2008

(87) PCT Pub. No.: WO2007/006253

PCT Pub. Date: Jan. 18, 2007

(65) Prior Publication Data

US 2008/0217105 A1 Sep. 11, 2008

(30) Foreign Application Priority Data

Jul. 7, 2005 (DE) ..... 10 2005 031 804

(51) Int. Cl.
*F01M 11/08* (2006.01)

(52) U.S. Cl.
USPC ..... 184/6.23; 184/6; 184/6.11; 184/6.12; 184/6.13; 184/6.16; 184/6.22; 184/6.26; 184/55.1; 184/55.2; 184/104.1; 60/39.08; 60/354; 60/651; 60/671; 60/726; 60/772

(58) Field of Classification Search
USPC ..... 184/6.23, 6.22; 60/39.08; 96/187; 55/400, 401, 409, 487
See application file for complete search history.

(56) References Cited

U.S. PATENT DOCUMENTS

| | | | | | |
|---|---|---|---|---|---|
| 2,888,097 | A * | 5/1959 | Scheffler, Jr. | ..... | 184/6.23 |
| 3,415,383 | A * | 12/1968 | Earle, Jr. et al. | ..... | 210/377 |
| 3,906,717 | A * | 9/1975 | Matthews | ..... | 60/39.08 |
| 4,049,401 | A | 9/1977 | Smith | | |
| 4,545,791 | A * | 10/1985 | Schweikl et al. | ..... | 96/187 |
| 6,237,322 | B1 * | 5/2001 | Rago | ..... | 60/39.08 |
| 2001/0047647 | A1 * | 12/2001 | Cornet | ..... | 60/39.02 |
| 2004/0098956 | A1 * | 5/2004 | Care et al. | ..... | 55/400 |

FOREIGN PATENT DOCUMENTS

| | | | |
|---|---|---|---|
| DE | 30 47 719 | A1 | 7/1982 |
| DE | 30 50 765 | C2 | 7/1982 |
| DE | 34 05 366 | A1 | 8/1985 |
| EP | 0 151 968 | A2 | 8/1985 |
| WO | WO 00/79103 | A1 | 12/2000 |

* cited by examiner

*Primary Examiner* — Robert A Siconolfi
*Assistant Examiner* — San Aung
(74) *Attorney, Agent, or Firm* — Crowell & Moring LLP

(57) ABSTRACT

A lubricant system is disclosed, in particular for the supply of lubricant to a user in a gas turbine aircraft engine. The system includes a lubricant reservoir, where in the lubricant reservoir a lubricant can be set in rotation by at least one rotatable drum that is integrated into the lubricant reservoir or by at least one rotatable blade that is integrated into the lubricant reservoir, such that the lubricant, as a result of centrifugal force, comes into contact against a rotationally symmetrical wall of the lubricant reservoir, and from there can be transported toward a user. A drive system is included for the or each rotatable drum or the or each rotatable blade of the lubricant reservoir. At least one rotating lubricant separator is provided for the venting of the lubricant. The or each lubricant separator can be driven by the drive system of the or of each rotatable drum and/or of the or of each rotatable blade of the lubricant reservoir.

8 Claims, 2 Drawing Sheets

LUBRICANT SYSTEM

BACKGROUND AND SUMMARY OF THE INVENTION

This application claims the priority of International Application No. PCT/DE2006/001116, filed Jun. 29, 2006, and German Patent Document No. 10 2005 031 804.5, filed Jul. 7, 2005, the disclosures of which are expressly incorporated by reference herein.

This invention relates to a lubricant system. The invention further relates to an assembly that carries a fluid, in particular a lubricant.

Lubricant systems of the prior art and in practice to supply a user with lubricant include, in addition to a lubricant reservoir, at least one lubricant pump for the extraction of the lubricant from the lubricant reservoir and for the transport of the lubricant toward the user and at least one lubricant pump for the return of the lubricant from the user into the lubricant reservoir. A static lubricant separator is normally integrated into the lubricant tank to separate the air from the lubricant in the mixture of lubricant and air that is returned to the lubricant reservoir and to remove the air from the lubricant reservoir. The air to be removed from the lubricant reservoir and the exhaust air from the user are conventionally conducted to a rotating lubricant separator, whereby the air separated by the rotating lubricant separator is removed from the lubricant system via an overboard vent line. In addition to the lubricant reservoir, the lubricant pumps and the lubricant separators comprise lubricant systems of the prior art to supply lubricant to a user, as well as lubricant filters and lubricant coolers which are connected between the lubricant reservoir and to the user.

On lubricant systems that are used, for example, to supply lubricant to a user in a gas turbine aircraft engine, it is important that the lubricant supply be maintained even under extreme flight conditions. This is problematic, in particular during extreme aerial maneuvers such as upside-down flight, parabolic flight in zero gravity or with a negative acceleration vector, as well as extreme ascents and extreme descents. To maintain the lubricant feed in these cases, such lubricant systems conventionally use a lubricant reservoir in which the lubricant is set in rotation by the rotation of at least one drum that is integrated into the lubricant reservoir or by the rotation of at least one blade that is integrated into the lubricant reservoir. During such a rotation, the lubricant, on account of centrifugal forces, comes into contact with a rotationally symmetrical wall of the lubricant reservoir, from where it can be transported toward the user.

In this manner, air is centrifuged out of the lubricant and collected in the center of the lubricant reservoir, from where the air centrifuged out can be removed from the lubricant reservoir. In this case, a static oil separator integrated into the lubricant reservoir can be omitted. Lubricant systems with a lubricant reservoir of this type are described, for example, in German Patent Document No. DE 30 50 765 C2 and in DE 34 05 366 C2.

On lubricant systems of this type it is modern practice to realize the lubricant reservoir, the rotating oil separator and a pump unit with the lubricant pumps in the form of separate assemblies or components and to drive these assemblies via separate drive systems. For this purpose, the lubricant reservoir, the lubricant pumps and the rotating lubricant separators are mounted on separate shafts, whereby a separate drive is associated with each of these separate shafts. The result is a complex construction for a lubricant system, whereby additional numerous external oil lines are required for the connection of the lubricant reservoir, rotating lubricant separators and lubricant pumps.

Against this background, the problem addressed by this invention is to create a novel lubricant system as well as a novel assembly that carries fluid, in particular lubricant.

The invention teaches that the rotating lubricant separator or each rotating lubricant separator can be driven by the drive system of the or each rotatable drum or of the or each rotatable blade of the lubricant reservoir.

This invention teaches that at least the or each rotating lubricant separator is driven by the drive system of the lubricant reservoir. For this purpose the or each rotating lubricant separator and the elements of the lubricant tank that are driven in rotation, namely the drum or each drum and/or the blade or each blade, are mounted on a common shaft and can be driven from the common drive, optionally with the interposition of a transmission. Consequently, a significantly simpler and more compact construction of a lubricant system can be realized, which maintains a lubricant supply to a user even under extreme operating conditions.

This invention teaches that a plurality of components of the lubricant system are combined into a single assembly, whereby in an aircraft engine this assembly can be realized in the form of a Line Replaceable Unit (LRU), to thereby guarantee easy maintenance and repair of a lubricant system.

In one advantageous development of the invention, at least one lubricant pump for the extraction of the lubricant from the lubricant reservoir and for the transport of the lubricant toward the user can be driven by the drive system of the or each rotatable drum or by the or each rotatable blade of the lubricant reservoir.

In a further advantageous development of the invention, at least one lubricant pump for the return of the lubricant into the lubricant reservoir can be driven by the drive system of the or each rotatable drum or of the or each rotatable blade of the lubricant reservoir.

Preferably the or each rotating lubricant separator and the or each lubricant pump for the extraction of the lubricant from the lubricant reservoir and the or each lubricant pump for the return of the lubricant into the lubricant tank as well as the or each rotatable drum or the or each rotatable blade can be mounted on a common shaft and can be driven by the shaft either directly or indirectly with the interposition of a transmission.

Preferred developments of the invention are described in the following description. Exemplary embodiments of the invention are explained in greater detail with reference to the accompanying drawings, although the invention is by no means limited to the specific exemplary embodiments illustrated.

DETAILED DESCRIPTION OF THE DRAWINGS

The invention is described in greater detail below with reference to FIGS. 1 to 4.

Figure 1:
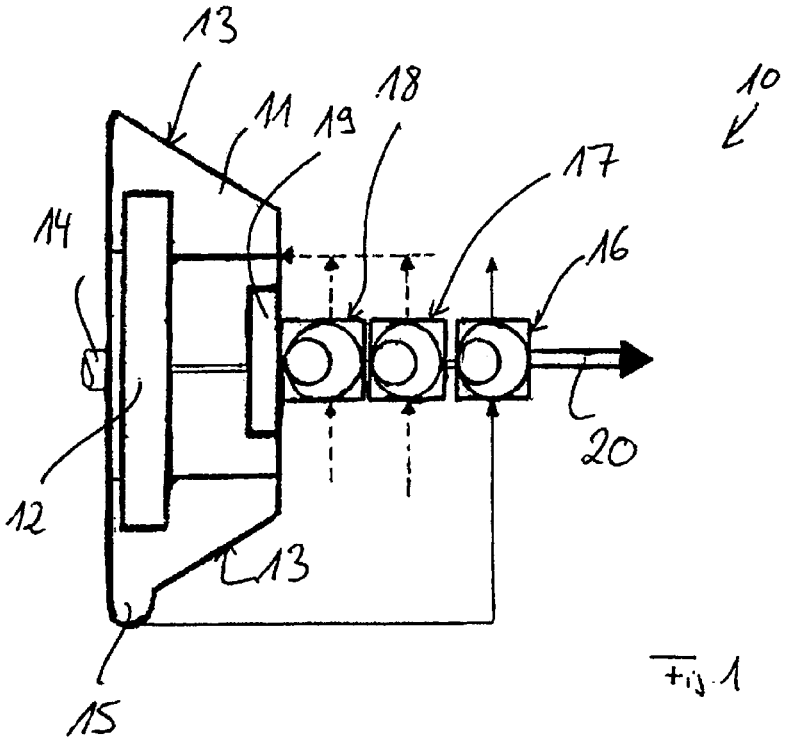
FIG. 1 is a schematic illustration of an assembly of a lubricant system in a first exemplary embodiment of the invention.

FIG. 1 is a schematic illustration of an assembly 10 of a lubricant system in a first exemplary embodiment of this invention. The assembly 10 illustrated in FIG. 1 comprises a lubricant reservoir 11, whereby rotating blades 12 are integrated into the lubricant tank 11 to set the lubricant in the lubricant reservoir 11 in rotation. A lubricant ring is thereby formed on a rotationally symmetrical wall 13 of the lubricant reservoir 11, whereby on account of the centrifugal forces acting on the lubricant, air is expelled from the lubricant by centrifugal force. The blades 12 driven in rotation are mounted on a shaft 14 and can be driven from a drive system (not shown) by the shaft 14. In the illustrated exemplary embodiment, the rotationally symmetrical wall 13 of the lubricant reservoir 11 is realized in the form of a truncated cone, whereby the lubricant is extracted in a segment 15 of the wall 13 by means of a lubricant pump 16 from the lubricant reservoir 11 and can be transported toward a user (not shown). In addition to the lubricant pump 16 for the extraction of the lubricant from the lubricant reservoir 11, FIG. 1 also shows two lubricant pumps 17 and 18 which are used for the return of the lubricant from the user into the lubricant reservoir 11. The lubricant pumps 17 and 18 return a mixture of lubricant and air into the lubricant reservoir 11, whereby the air is expelled by centrifugal force from the lubricant by the rotation of the blades 12 that are integrated into the lubricant reservoir 11 and by the realization of the lubricant ring on the wall 13 of the reservoir 11. The air is accumulated in a central section of the lubricant tank 11 and before it is conducted out of the lubricant reservoir 11 it is guided through a rotating lubricant separator 19. After passing through the rotating lubricant separator 19, the air that has been separated from the lubricant is removed via an overboard vent line 20.

In the invention, the components of a lubricant system illustrated in FIG. 1 are combined into an assembly 10. The rotating lubricant separator 19 can be driven by the drive of the rotating blades 12 and for this purpose can be mounted on the same shaft 14 as the blades 12. Likewise, the lubricant pump 16 for the extraction of the lubricant from the lubricant reservoir 11 can be driven by the drive system of the blades 12. Furthermore, the lubricant pumps 17 and 18 which are used for the return of the lubricant into the lubricant reservoir 11 can be driven by the drive system of the blades 12. For this purpose the lubricant pumps 16, 17 and 18, as well as the rotating lubricant separator 19, are mounted on the shaft 14, on which the blades 12 that are integrated into the lubricant reservoir 11 are also mounted. The invention therefore teaches that all of the components of the assembly 10 that are to be driven, i.e., the blades 12, the rotating lubricant separator 19 and the lubricant pumps 16, 17, 18, are driven by a single drive system, and namely either directly or indirectly with the interposition of a corresponding transmission. As a result of the interposition of a transmission between the shaft 14 and the individual components to be driven, it is possible to drive the blades 12, the rotating lubricant separator 19 and the lubricant pumps 16, 17 and 18 at individual speeds of rotation. In the exemplary embodiment illustrated in FIG. 1, the rotating lubricant separator 19 is integrated into the lubricant reservoir 11 while the lubricant pumps 16, 17 and 18 are positioned outside the lubricant reservoir 11.

The assembly 10 in the exemplary embodiment illustrated in FIG. 1 is characterized by a compact construction and can be realized in the form of a Line Replaceable Unit (LRU). It thereby becomes possible to replace the assembly 10 as a unit when maintenance work is being performed on a lubricant system. Even under extreme operating conditions, such as for example in negative acceleration vectors or during extreme flight maneuvers, the assembly illustrated in FIG. 1 can guarantee a continuous feed of lubricant to a user. The assembly 10 can be integrated into a gas turbine aircraft engine so that the shaft 14 on which the blades 12, the rotating lubricant separator 19 and the lubricant pumps 16, 17 and 18 are mounted extends either in the longitudinal direction or in the transverse direction with respect to the axis of the engine. The shaft 14 can be driven electrically, hydrostatically, hydrodynamically or even pneumatically. It is also possible to drive the shaft 14 mechanically by means of the main aircraft engine shaft with the interposition of a transmission.

Figure 2:
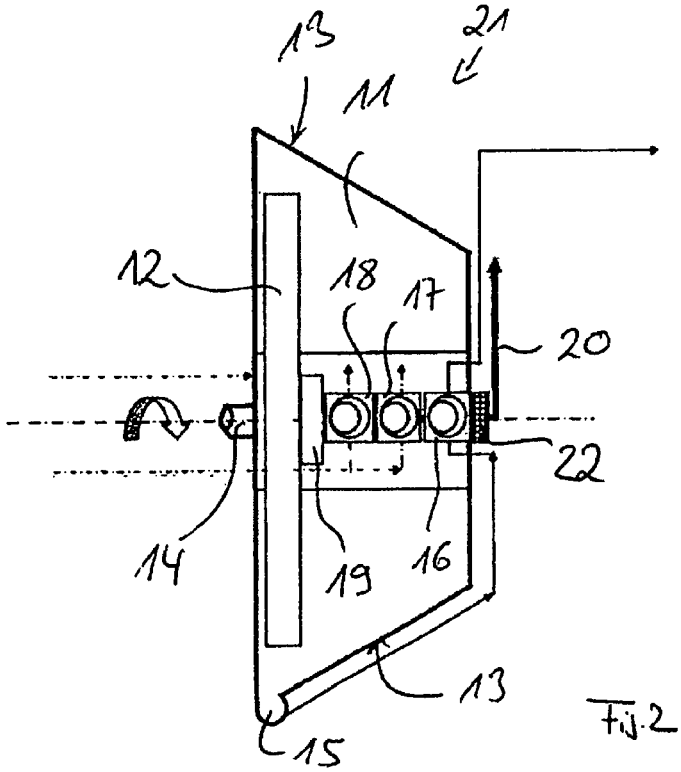
FIG. 2 is a schematic illustration of an assembly of a lubricant system in a second exemplary embodiment of the invention.

FIG. 2 shows an assembly 21 for a lubricant system in a second exemplary embodiment of the invention, whereby the assembly 21 in FIG. 2 has the same components as the assembly 10 illustrated in FIG. 1. Therefore, to avoid needless repetition, the same reference numbers are used for the same assemblies. The assembly 21 in FIG. 2 differs from the assembly 10 in FIG. 1 in that in the assembly 21 in FIG. 2, the pump unit comprising the lubricant pumps 16, 17 and 18 is integrated into the lubricant reservoir 11. As a result, the size of the overall construction can be reduced even further. The blades 12, the rotating lubricant separator 19 and the lubricant pumps 16, 17 and 18 are in turn mounted on a common shaft 14 and are driven from a common drive system. With regard to these details, reference can be made to the comments on the assembly 10 illustrated in FIG. 1. FIG. 2 shows that the overboard vent line 20 is sealed with respect to the rotating shaft 14 by a seal 22. A seal of this type can also be present in the assembly 10 illustrated in FIG. 1.

In the exemplary embodiments illustrated in FIGS. 1 and 2, the overboard vent line 20 is preferably extended upward far enough that under static conditions in the lubricant reservoir 11, the level of the lubricant lying above the shaft 14 cannot lead to a loss of lubricant via the overboard vent line 20. At the end of the overboard vent line 20, a grid or a honeycomb structure can be located to prevent a flashback into the lubricant reservoir 11. If an elevated pressure inside the lubricant reservoir 11 is desired, the overboard vent line 20 can be associated with a pressure regulation valve.

Figure 3:
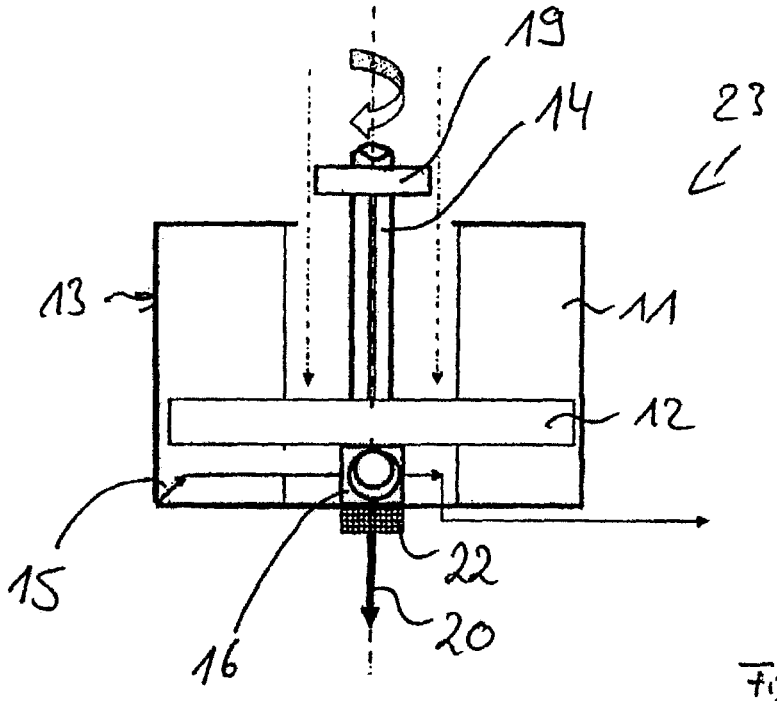
FIG. 3 is a schematic illustration of an assembly of a lubricant system in a third exemplary embodiment of the invention.
Figure 4:
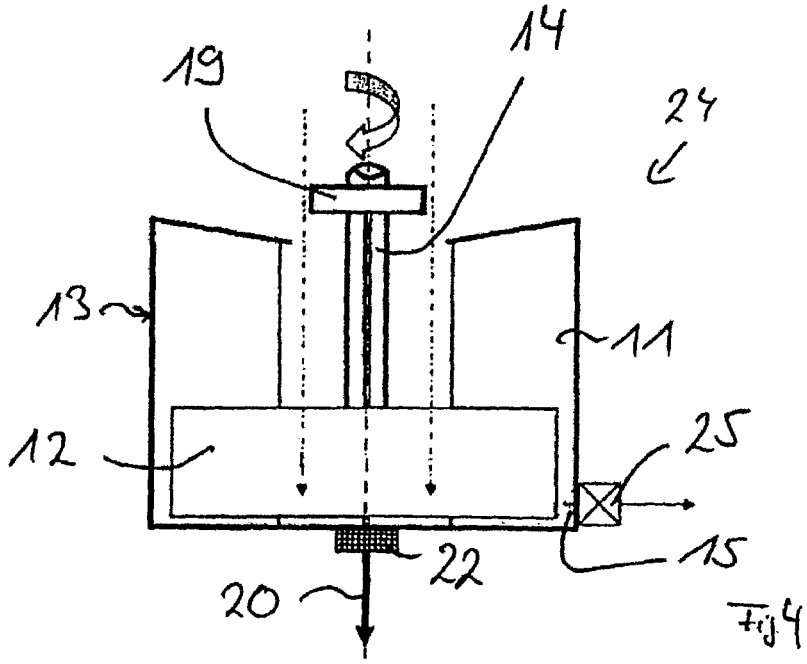
FIG. 4 is a schematic illustration of an assembly of a lubricant system in a fourth exemplary embodiment of the invention.

In the exemplary embodiments illustrated in FIGS. 1 and 2, the shaft 14 extends in the horizontal direction. FIGS. 3 and 4, on the other hand, illustrate exemplary embodiments of assemblies 23 and 24 with a shaft 14 that runs vertically, whereby in these assemblies 23 and 24 the lubricant flows back into the lubricant reservoir 11 by gravity, which means that the lubricant pumps 17 and 18 for the return of the lubricant into the lubricant reservoir 11 can be omitted.

In the exemplary embodiment illustrated in FIG. 3, the rotating lubricant separator 19 and the lubricant pump 16 for the extraction of the lubricant from the lubricant reservoir 11 are mounted on a common shaft 14 and can be driven via this shaft 14 by a common drive system, whereby this drive system is also the drive system of the blades 12 that are also mounted on the shaft 14. As shown in FIG. 3, the lubricant separator 19 is positioned above a partition of the lubricant reservoir 11.

In the exemplary embodiment illustrated in FIG. 4, at a correspondingly high pressure on the wall 13 of the lubricant reservoir 11, with a high speed of rotation of the blades 12 and thus of the lubricant ring that is in contact with the wall 13, the lubricant pump 16 for the extraction of the lubricant from the lubricant reservoir 11 can also be omitted, whereby the lubricant flow can then be regulated by an appropriate pressure regulation valve 25.

To prevent lubricant losses when the shaft 14 is vertical, the rotating lubricant separator 19 in the exemplary embodiment illustrated in FIGS. 3 and 4 is positioned above the level of the stationary oil level which is realized with a vertical shaft 14 in the lubricant reservoir 11.

The lubricant system is preferably used in a gas turbine aircraft engine. It should be noted, however, that other applications of the assemblies illustrated in FIGS. 1 to 4 are possible. For example, these assemblies can be used in lubricant systems of a stationary gas turbine or in lubricant systems of a ship's turbines. The lubricant system can also be used for the lubrication of electric power generators, electric motors as well as piston engines for aircraft, ships, land vehicles or even for stationary applications. Use in a hydraulic system or any other system with a fluid circuit is also possible, and specifically in applications in which acceleration vectors are variable or in zero gravity.

The invention claimed is:

1. A lubricant system, comprising a lubricant reservoir, wherein in the lubricant reservoir a lubricant is settable in rotation by a rotatable drum or by a rotatable blade that is integrated into the lubricant reservoir, so that as a result of centrifugal force the lubricant comes into contact with a rotationally symmetrical radial outer wall of the lubricant reservoir formed as a truncated cone, and from there is transportable toward a user, a rotatable lubricant separator integrated into the lubricant reservoir for removal of air from the lubricant, a shaft extending through the lubricant reservoir wherein the rotatable drum or the rotatable blade is disposed on a first axial end of the shaft in the lubricant reservoir and wherein the rotatable lubricant separator is disposed on a second axial end of the shaft in the lubricant reservoir, and a drive wherein the drive drives a rotation of the shaft.

2. The lubricant system according to claim 1, further comprising a transmission interposed between the shaft and the rotatable drum or the rotatable blade and/or the rotatable lubricant separator.

3. The lubricant system according to claim 1, further comprising a lubricant pump for return of the lubricant into the lubricant reservoir disposed on the shaft.

4. The lubricant system according to claim 3, further comprising a transmission interposed between the shaft and the lubricant pump.

5. The lubricant system according to claim 1, wherein the shaft runs horizontally.

6. An assembly that carries a fluid, comprising a fluid reservoir, wherein in the fluid reservoir, the fluid is settable in rotation by a rotatable drum integrated into the fluid reservoir or by a rotatable blade integrated into the fluid reservoir such that the fluid, as a result of centrifugal force, comes into contact with a rotationally symmetrical radial outer wall of the fluid reservoir formed as a truncated cone and from there is transportable toward a user, a rotatable separator integrated into the fluid reservoir for removal of air from the fluid, a shaft extending through the fluid reservoir wherein the rotatable drum or the rotatable blade is disposed on a first axial end of the shaft in the fluid reservoir and wherein the rotatable separator is disposed on a second axial end of the shaft in the fluid reservoir, and a drive wherein the drive drives a rotation of the shaft.

7. The assembly according to claim 6, further comprising a transmission interposed between the shaft and the rotatable drum or the rotatable blade and/or the rotatable separator.

8. A lubricant system, comprising:

a lubricant reservoir, wherein a rotationally symmetrical radial outer wall of the lubricant reservoir is formed as a truncated cone;

a rotational member disposed within the lubricant reservoir;

a rotational lubricant separator disposed within the lubricant reservoir;

a shaft extending through the lubricant reservoir, wherein the rotational member is disposed on a first axial end of the shaft in the lubricant reservoir and wherein the rotational lubricant separator is disposed on a second axial end of the shaft in the lubricant reservoir; and a drive, wherein the drive drives a rotation of the shaft.

* * * * *